United States Patent [19]

Nagayama

[11] Patent Number: 4,674,858

[45] Date of Patent: Jun. 23, 1987

[54] PHOTOCONDUCTIVE ELEMENT UNIT FOR LASER PRINTER OR THE LIKE

[75] Inventor: Haruhiko Nagayama, Tokyo, Japan

[73] Assignee: Ricoh Company, Ltd., Tokyo, Japan

[21] Appl. No.: 701,517

[22] Filed: Feb. 14, 1985

[30] Foreign Application Priority Data

| | | | |
|---|---|---|---|
| Feb. 17, 1984 | [JP] | Japan | 59-21407[U] |
| Feb. 17, 1984 | [JP] | Japan | 59-21408[U] |
| Feb. 17, 1984 | [JP] | Japan | 59-21409[U] |
| Feb. 17, 1984 | [JP] | Japan | 59-21410[U] |
| Feb. 17, 1984 | [JP] | Japan | 59-21411[U] |
| Feb. 17, 1984 | [JP] | Japan | 59-21413[U] |
| Feb. 17, 1984 | [JP] | Japan | 59-21414[U] |
| Feb. 18, 1984 | [JP] | Japan | 59-21942[U] |

[51] Int. Cl.[4] ..... G03G 21/00; G03G 15/00

[52] U.S. Cl. ..... 355/3 BE; 355/16

[58] Field of Search ..... 355/3 R, 3 BE, 16

[56] References Cited

U.S. PATENT DOCUMENTS

| | | | |
|---|---|---|---|
| 3,836,245 | 9/1974 | Hastwell et al. | 355/16 X |
| 4,402,593 | 9/1983 | Bernard et al. | 355/3 BE |
| 4,403,851 | 9/1983 | Yanagawa | 355/3 BE X |
| 4,544,260 | 10/1985 | Kolbe | 355/3 BE |
| 4,551,001 | 11/1985 | Yokota | 355/3 R X |
| 4,563,077 | 1/1986 | Komada | 355/3 BE |

*Primary Examiner*—Fred L. Braun

*Attorney, Agent, or Firm*—Oblon, Fisher, Spivak, McClelland & Maier

[57] ABSTRACT

A photoconductive element unit for use with a laser printer or the like and having a belt-like photoconductive element. A main frame and a subframe extensible and contractible relative to the main frame support shafts which are associated with individual rollers over which the photoconductive element is passed. The shafts are constantly biased away from each other by springs. An upper cover and a lower cover cooperate to accommodate the whole unit thereinside. The unit includes slide members slidably supported by the upper and lower covers, loosening members for displacing the shafts toward each other against the action of springs, and grid plate support members.

11 Claims, 24 Drawing Figures

PHOTOCONDUCTIVE ELEMENT UNIT FOR LASER PRINTER OR THE LIKE

BACKGROUND OF THE INVENTION

1. Field of the Invention

The present invention relates to a photoconductive element unit for use with a copier, facsimile transceiver, laser printer or like recording apparatus and, more particularly, to an improvement in a photoconductive element unit of the type having a belt-like photoconductive element passed over a pair of rollers which are supported by individual support members.

2. Discussion of the Background

Photoconductive elements applicable to copiers, laser printers and others include one which is configured by looping a belt-like photoconductive element and interconnecting opposite ends of the loop. Generally, such a photoconductive element, or belt as will hereinafter be referred to, is movably passed over at least a pair of rollers which are supported by individual shafts, or support shafts, which in turn are resiliently biased away from each other. The problem with the belt is that it undergoes deterioration due to repeated use and has to be replaced with another after a predetermined number of operation cycles, resulting in inefficient maintenance as is often experienced.

One approach heretofore proposed to solve the above problem is a photoconductive element unit which is assembled by mounting the rollers and belt on a support frame and, then, mounting the support frame bodily in a pair of upper and lower covers. The unit is freely removable from the housing of the associated apparatus to facilitate maintenance and, if provided with a disposable nature, makes maintenance practically needless.

The prior art photoconductive element unit, however, has left various problems unsolved in itself and in relation to other instruments which will surround it when loaded in a recording apparatus, as will be enumerated.

(1) Generally, the belt is manually set in its operative position by reducing the spacing between the shafts for supporting the opposite rollers, which are supported by the support frame, and then wrapping the belt around the rollers. The inconvenience which arises here is that, since the support frame comprises a single member and one of the shafts (usually a driven shaft) is provided with a tendency to move outwardly by a spring for increasing the spacing between the two shafts, one has to put the belt around the rollers against such a tendency. Meanwhile, the displacement stroke of the distance between the shafts during the belt loading operation cannot be designed to be very large considering deterioration to the resiliency of the spring. For this reason, where linings are applied to both inner peripheral edges of the belt in order to prevent the belt from becoming offset in position, for example, the belt cannot be set without reducing the distance between the support shafts much more than usual, making the manipulation far more difficult.

(2) As described above in (1), in order to drive the belt constantly under tension, one of the shafts needs be supported while being biased by springs away from the other support shaft. In addition, since the rotation of the resiliently supported shaft cannot be smooth, it is preferable to fix the shaft in place by some suitable means so that only the associated roller may rotate. Although this problem with the photoconductive element unit has been solved by various schemes, all such prior art schemes have relied on physically independent means which add to the number of structural parts and elements and contradictory to the trend toward a small-size construction.

(3) The photoconductive element unit, which is independent of the housing of its associated apparatus such as a copier, constantly holds the belt under tension between the rollers within the unit and, therefore, it is stored or transported without releasing the belt from the tension. It follows that a long period of time of storage or transportation of the unit causes the belt to undergo creep deformation due to the constant tension as well as variations in ambient temperature during storage or transportation, the opposite portions of the belt being likely to be fixed in the bent shape so as to cause waving during operation of the unit. Waving of the belt affects the parallelism between the belt and a charger, developing roller, grid plate and others and generates gaps therebetween and, thereby, invites damage to the belt due to unusual discharges and/or contact.

(4) In order that the photoconductive element unit may be free to move into and out of the housing of the apparatus such as a copier, both the unit and the housing have to be provided with individual guide means for holding them in a mating relationship. In addition, the guide means should insure very accurate correspondence between the belt in the unit which is loaded in the apparatus housing and various instruments which will then be positioned around the belt, with respect to the spacing and other factors which are necessary for providing high quality images. Concerning a disposable design of the photoconductive element unit, it is advantageous from the cost standpoint to produce the covers and the like using plastics. However, the covers made of plastic would be detrimental to the accuracy of the guide means which would be formed therein. Covers made of metal, although preferable from the accuracy standpoint, would increase the costs of the unit too much to deserve disposable use.

(5) When the photoconductive element unit is placed in an operative position inside its associated apparatus, it faces various instruments which are fixedly mounted in the apparatus such as a charger, transfer charger, cleaning roller and sheet guide plate. Among them, the sheet guide plate should preferably be located as near to the belt as possible so that a sheet may contact the belt as closely as possible to enhance transfer efficiency. In practice, however, guide channels formed through unit guide members, which are installed in the apparatus to allow the unit to be transferred into and out of the housing, are usually dimensioned somewhat larger in a position adjacent to an inlet of the housing for inserting the unit than in a position where the insertion of the unit is completed for the purpose of avoiding needless contact of the unit with the guide channels. In case the roller support shafts of the unit are used as guide shafts of the unit and the unit is moved into and out of the apparatus housing with the guide shafts engaged in the guide channels of the apparatus, the support shafts necessarily reach the wider portion of the guide channels in the course of the movement so that the unit is bodily lowered by an amount complementary to the difference in width of the guide channels. Further, since one of the support shafts is resiliently supported as earlier mentioned, it causes the belt to slacken while moving in contact with the edges of the guide channels. It will thus be seen that should the sheet guide plate be located too close to the belt, the belt would make contact therewith due to the downward shift and slackening of the belt and, thereby, be damaged. Such becomes more significant as the unit moves outwardly away from the operative position in the housing (or inwardly toward the operative position in case the resiliently supported shaft is positioned ahead of the other shaft). If an end portion of the sheet guide plate is positioned at a substantial spacing from the belt in an attempt to cope with the above situation, a rear end portion of a sheet being conveyed along the plate will spring into contact with the belt when it leaves the plate, disturbing transferred images in the rear end portion of the sheet.

(6) A laser printer is constructed to, as in a copying process of an electrophogoraphic copier, for example, charge an imaging surface of a moving belt by means of a charger, illuminate the charged surface by a laser beam which carries information to provide an electrostatic latent image, develop the latent image by means of a toner, and transfer the resulting toner image to a sheet and fix it on the sheet. In this type of printer, the amount of charge applied by the charger to the belt is usually controlled by controlling the voltage applied to a grid which is interposed between the charger and the belt. The grid comprises, for example, a sheet of stainless steel which has numerous apertures formed in a mesh by etching (hereinafter referred to as a grid plate). The grid plate has customarily been directly mounted on the charger or the upper cover of the photoconductive element unit. However, in case the grid plate is mounted directly on the charger, cumulative errors develop during assembly of the charger and its support member and that of the belt and its support unit prevents parallelism from being set up between the belt and the grid plate. On the other hand, in case the grid plate is mounted on the upper cover of the photoconductive element unit, the unitary construction of the upper cover and belt may theoretically improve the parallelism (dimensional accuracy) to a remarkable extent. In practice, however, at the time when the grid is put under tension by a coiled torsion spring in order to absorb slackening of the grid and the like, the tension causes the upper cover to deform to contact and damage the belt.

(7) In a copier, laser printer or like apparatus, an optical system for exposure is usually confined in a casing which resembles a dark box and serves to present entry of light from the outside. Also, the outlet of an optical path defined in the casing is shut up by a dust-tight glass against entry of dust and developer particles into the casing. In addition, the apparatus is provided with a fan for ventilation which discharges to the outside of the apparatus ozone resulting from corona discharges performed by the charger, so that the belt is free from deterioration due to the ozone. The fan generates a stream of air inside the apparatus which follows along a given path toward the fan as it is operated. Disposed around the belt are, from the upstream side, a charger, the dust-tight glass associated with the optical arrangement, a developing roller, a transfer charger (or a transfer roller), and a cleaning roller. Among them, the charger, dust-tight glass and developing roller are positioned close to each other in order to provide a toner image rapidly on the belt. The fan, on the other hand, usually assumes a position which is as remote as possible from the developing roller and effective to efficiently discharge the ozone produced by the charger, so that the toner image on the belt may not be disturbed by the stream of air. In this construction, the developing roller which is remotest from the fan is positioned at the upstream of the air stream. Hence, assuming that the air stream starts at the developing roller, the dust-tight glass of the optical arrangement and the charger are located at the downstream side as seen from the developing roller side. As a result, toner particles scattering around the developing roller due to the rotation of the roller, which is usually about seven times as fast as the rotation of the belt, are apt to be entrained by the air stream to contaminate the air-tight glass and charger and, thereby, reduce the quantity of light available for exposure and/or unusual discharging.

SUMMARY OF THE INVENTION

It is therefore an object of the present invention to provide a photoconductive element unit applicable to a laser printer or the like which includes a tension structure for a belt-like photoconductive element capable of allowing the photoconductive element to be readily stretched in an operative position between a pair of rollers.

It is another object of the present invention to provide a photoconductive element unit applicable to a laser printer or the like which includes a roller support arrangement capable of implementing a pair of roller support shafts by a small number of parts and with a minimum of space requirement and, at the same time, preventing the support shafts from rotating and biasing them by means of the same members.

It is a further object of the present invention to provide a photoconductive element unit applicable to a laser printer or the like which includes a loosening member for reducing the tension in a belt-like photoconductive element to thereby eliminate creep and other deformations.

It is an additional object of the present invention to provide a photoconductive element unit applicable to a laser printer or the like in which support shafts each supporting a roller over which a belt-like photoconductive element is passed bifunctionally as guide shafts of the unit.

It is another object of the present invention to provide a photoconductive element unit applicable to a laser printer or the like which eliminates various problems which are liable to occur between a photoconductive element of the unit and a sheet guide plate.

It is yet another object of the present invention to provide a grid support device in which a support member for a grid interposed between a photoconductive element of a laser printer and a charger is prevented from being deformed by tension.

It is a further object of the present invention to provide a photoconductive element unit which is capable of preventing developer particles and the like from depositing on a dust-tight glass which is positioned at an output of an optical path in an exposing section.

It is yet another object of the present invention to provide a generally improved photoconductive element unit applicable to a laser printer or the like.

A photoconductive element unit removably mounted in a recording apparatus and having a belt-like photoconductive element of the present invention comprises a support frame member comprising a main frame and a subframe arranged to be extensible and contractible relative to the main frame, a pair of rollers mounted on individual support shafts which respectively are supported by an end portion of the main frame and an end portion of the subframe which are remote from each other, and a biasing device for biasing the rollers in a direction for yieldably increasing a distance between the rollers to mounting the photoconductive element in a loop form over the rollers under tension in such a manner as to cover the frame member.

In accordance with the present invention, a photoconductive element unit for used with a laser printer or the like and having a belt-like photoconductive element is provided. A main frame and a subframe extensible and contractible relative to the main frame support shafts which are associated with individual rollers over which the photoconductive element is passed. The shafts are constantly biased away from each other by springs. An upper cover and a lower cover cooperate to accommodate the whole unit thereinside. The unit includes slide members slidably supported by the upper and lower covers, loosening members for displacing the shafts toward each other against the action of springs, and grid plate support members.

The above and other objects, features and advantages of the present invention will become more apparent from the following detailed description taken with the accompanying drawings.

DESCRIPTION OF THE PREFERRED EMBODIMENTS

While the photoconductive element unit for a laser printer or the like of the present invention is susceptible of numerous physical embodiments, depending upon the environment and requirements of use, substantial numbers of the herein shown and described embodiments have been made, tested and used, and all have performed in an eminently satisfactory manner.

Figure 1:
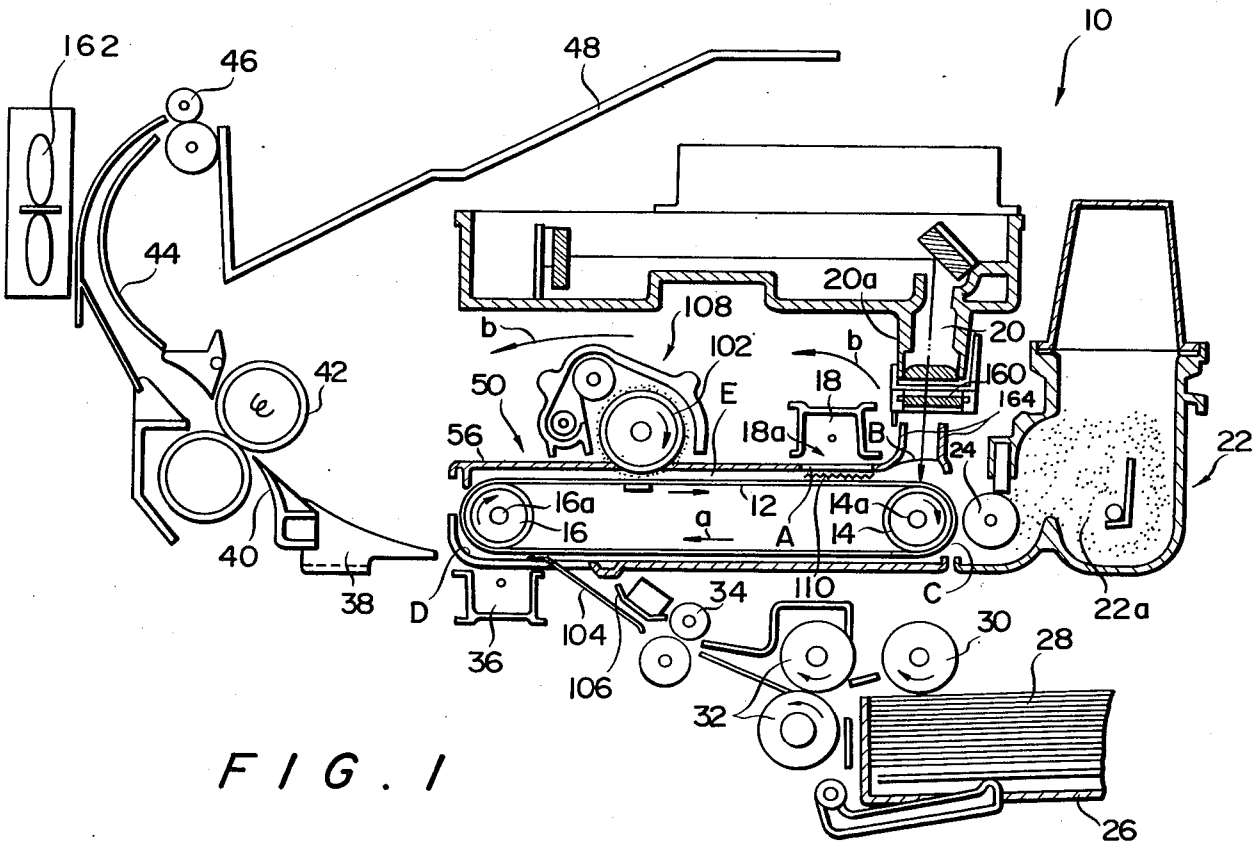
FIG. 1 is a schematic view of a laser printer to which the present invention is applicable.

Referring to FIG. 1 of the drawings, there is shown a laser printer using a photoconductive element unit in accordance with the present invention and which is generally designated by the reference numeral 10. The photoconductive element unit includes a belt-like photoconductive element.

In FIG. 1, a belt-like photoconductive element, or belt, 12 is passed over a pair of rollers 14 and 16 and rotated in a direction indicated by an arrow a. The belt 12 is charged to a predetermined polarity by a charger 18 and, then, illuminated through an optical system 20 for exposure by an information carrying laser beam, whereby a latent image is provided electrostatically on the belt 12. The latent image is developed by a toner **22*a* which is supplied by the rotation of developing roller 24 of a developing unit 22**.

A stack of sheets 28 are stored in a sheet cassette 26. The sheets 28 are fed one at a time from the top of the stack by rotatable sheet feed rollers 30 and, then, by rollers 32 until the front end of the sheet becomes nipped by register rollers 34. As soon as the front end of the toner image is brought into alignment with that of the sheet 28 by the rotation of the belt 12, the register rollers 34 are rotated to advance the sheet along the belt 12 and, in the course of this travel of the sheet 28, the toner image is transferred from the belt 12 to the sheet 28 by a transfer charger 36. The sheet 28 now carrying the toner image thereon is guided by guide plates 38 and 40 and, then, fed farther to a discharge tray 48 by discharge rollers 46.

Figure 2:
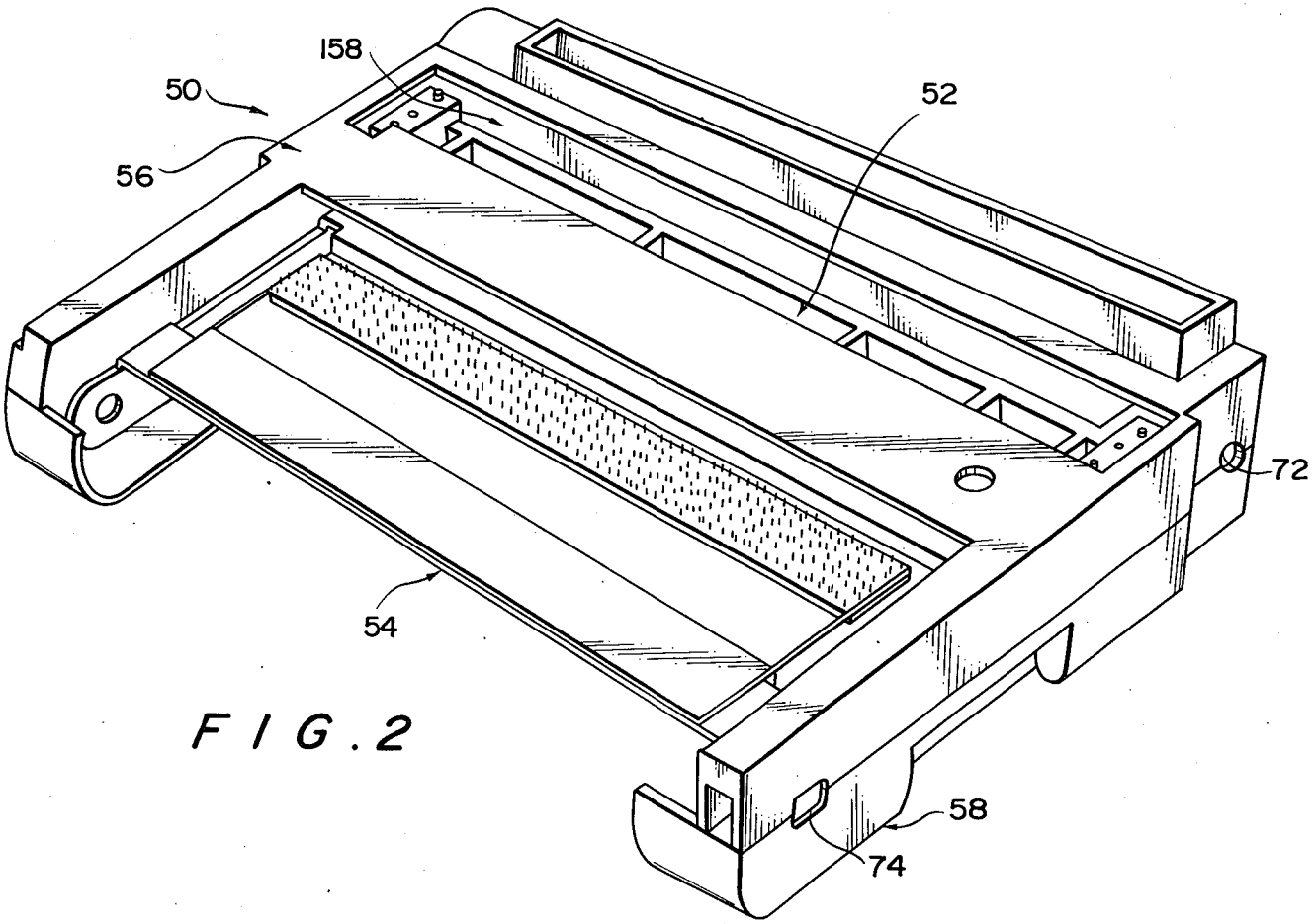
FIG. 2 is a perspective view of an exemplary photoconductive element unit installed in the printer of FIG. 1.
Figure 3:
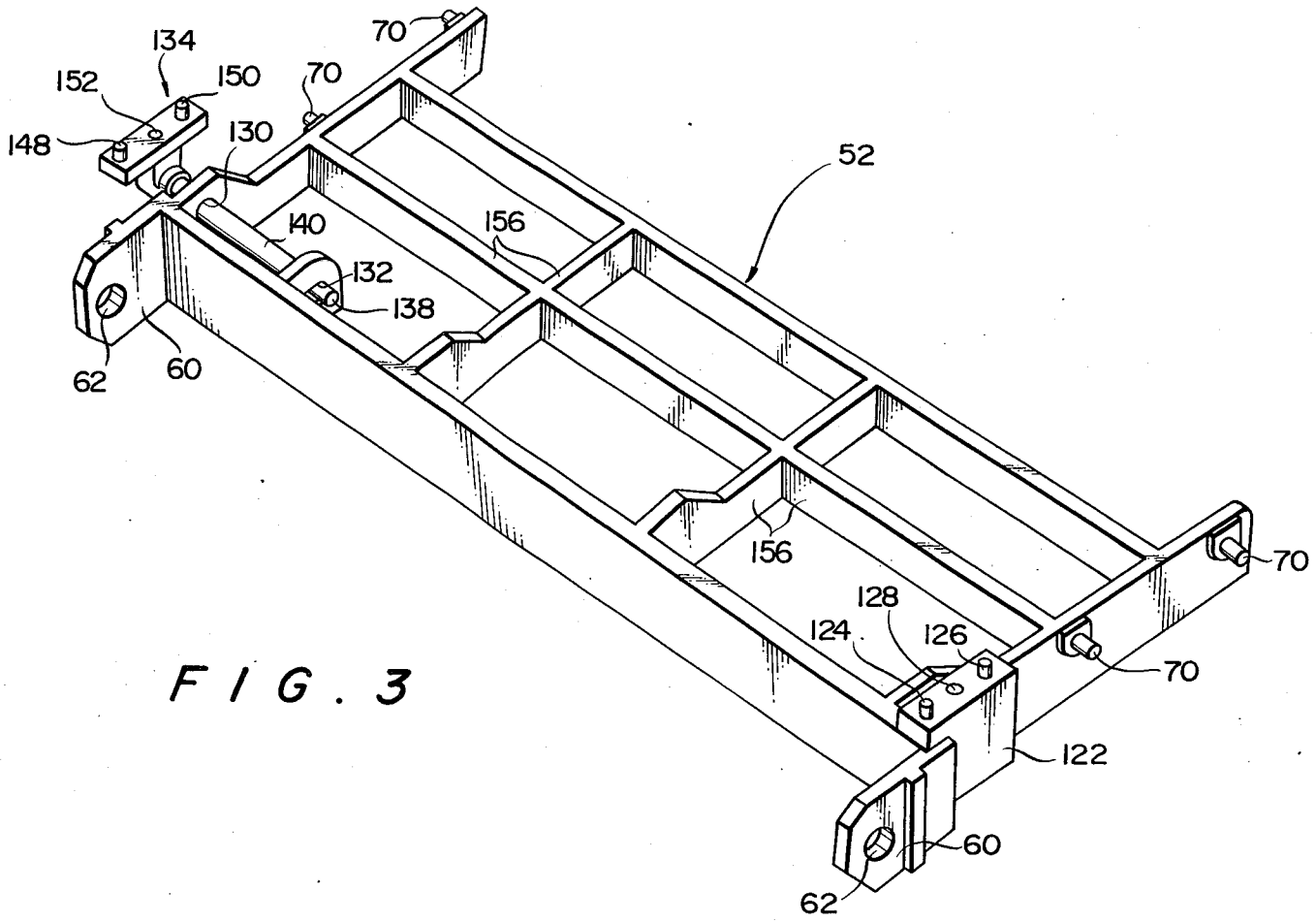
FIG. 3 is a perspective view of a main frame included in the photoconductive element unit of FIG. 2.
Figure 4:
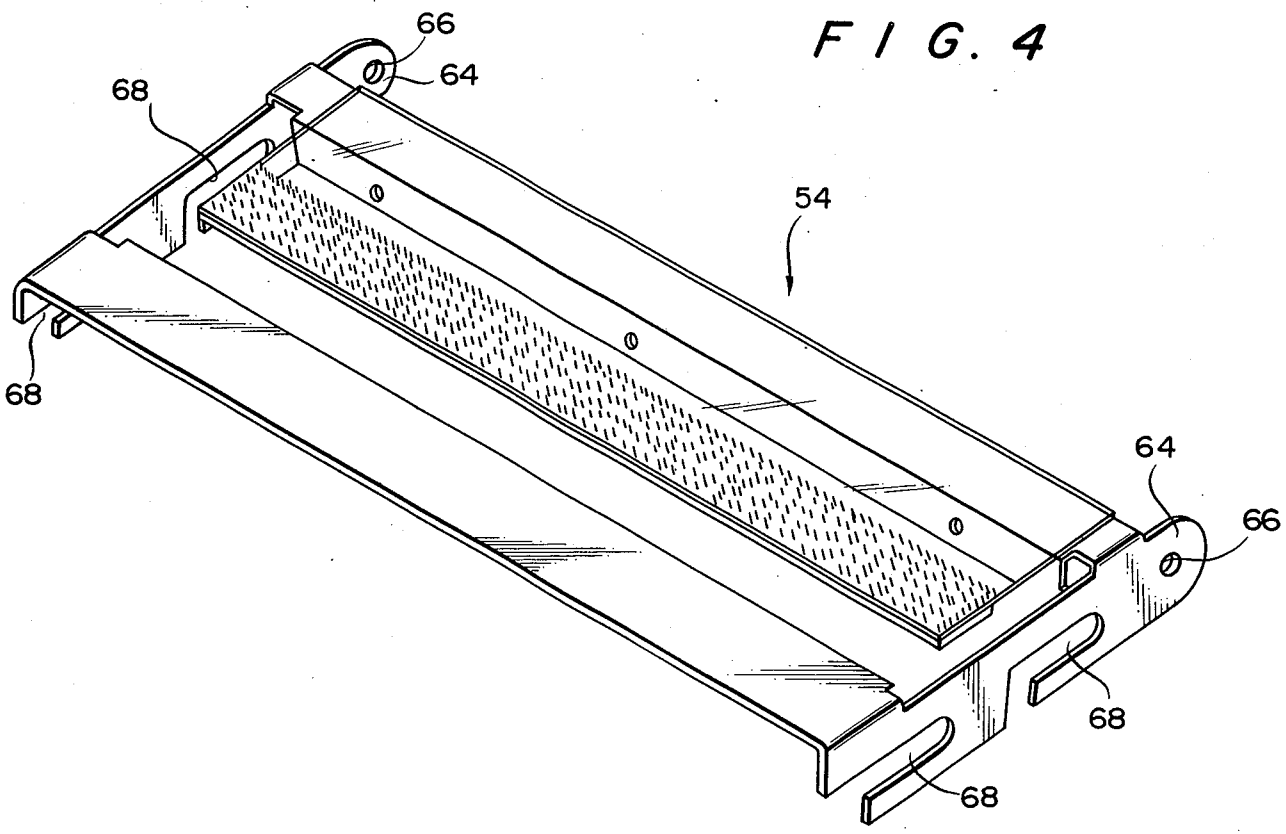
FIG. 4 is a perspective view of a subframe also included in the unit of FIG. 2.
Figure 5:
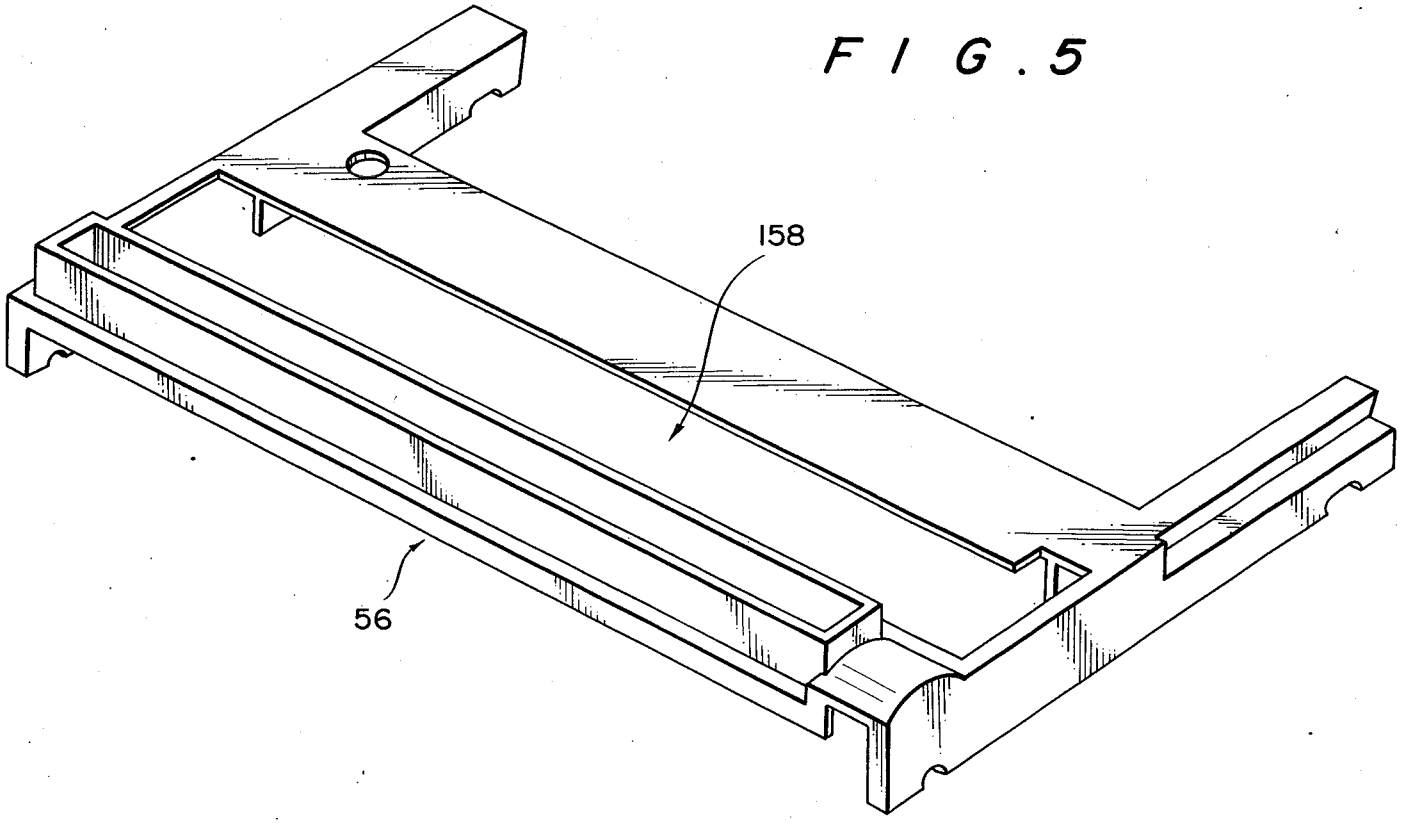
FIG. 5 is a perspective view of an upper cover of the unit of FIG. 2.
Figure 6:
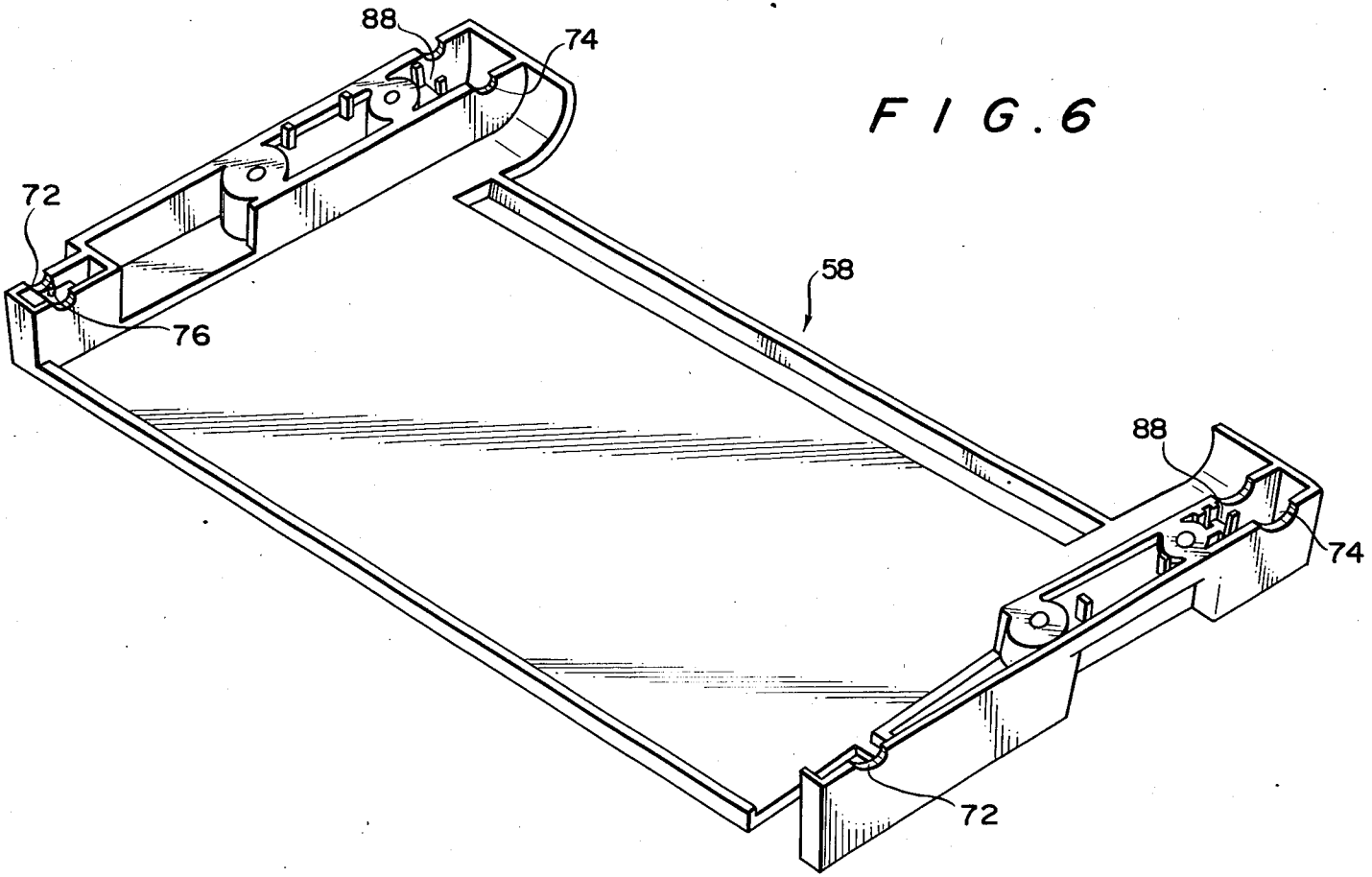
FIG. 6 is a perspective view of a lower cover of the unit of FIG. 2.

Referring to FIG. 2, an example of a photoconductive element unit is shown which allows the belt 12 in the apparatus 10 and the rollers 14 and 16 for supporting the belt 12 to be assembled in a unitary construction. In the photoconductive element unit, generally 50, a frame for supporting the rollers 14 and 16 comprises a main frame 52 and a subframe 54 (FIGS. 3 and 4). In addition to the frames 52 and 54, the unit 50 includes an upper cover 56 (FIG. 5) and a lower cover (FIG. 6) for covering both the frames 52 and 54.

One of the rollers 14 and 16 is received in openings 62 which respectively are formed through a pair of bearing portions 60 provided in front opposite sides of the main frame 52 as viewed in FIG. 3. The other roller 16 is received in openings 66 formed through a pair of bearing portions 64 which are provided in rear opposite sides of the subframe 54 as viewed in FIG. 4.

Figure 7:
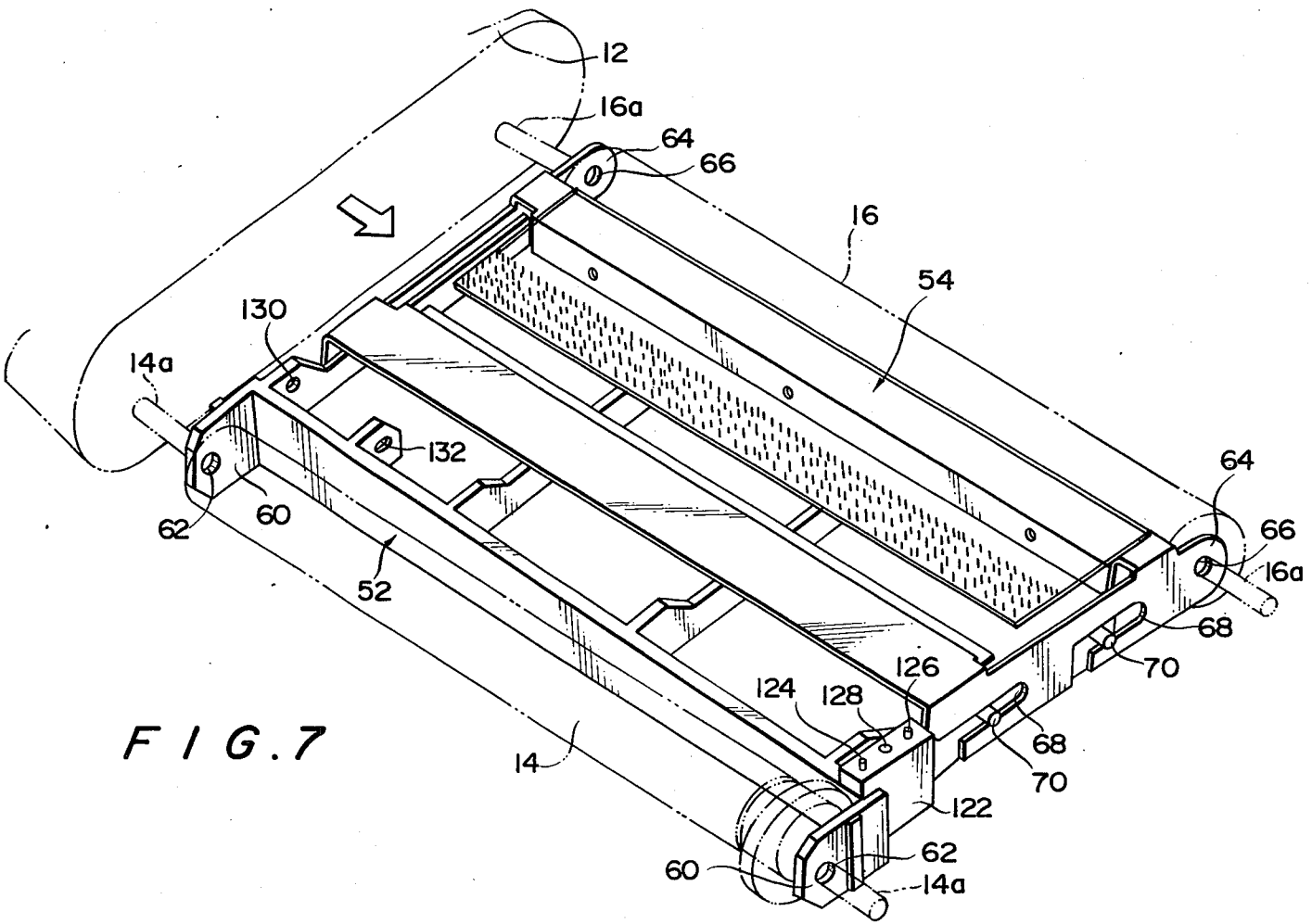
FIG. 7 is a perspective view of an assembly of the main frame and subframe.

The subframe 54 is provided with a pair of slots 68 at each of its opposite sides, while the main frame 52 is provided with pins 70 protruding from its opposite sides. As shown in FIG. 7, the subframe is coupled with the main frame 52 with the slots 68 engaged respectively with the pins 70 and is capable of extending and contracting relative to the main frame 52.

The belt 12 is applied to the support frame from one side of the latter by holding the frames 52 and 54 in their contracted position, that is, such that the belt 12 covers both the frames 52 and 54. As seen from the above, since the support frame associated with the rollers 14 and 16 in accordance with the present invention is made up of two physically separate parts, the belt 12 can be mounted quite easily and without being damaged.

After the belt 12 has been loaded as described above, the frames 52 and 54 are extended and, in this position, mounted on the lower cover 58. That is, with the belt 12 attached to the rollers 14 and 16, a support shaft, or simply shaft, **14*a* supporting the roller 14 corresponds in position to bearing portions 72 which are formed in front opposite sides of the lower cover 58 as viewed in FIG. 6, while a shaft 16*a* supporting the roller 16 corresponds to slot-like bearing portions 74 which are formed in rear opposite sides of the lower cover 58**.

Figure 8:
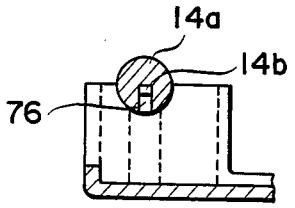
FIG. 8 is a fragmentary section showing correspondence between a lower cover and one of roller support shafts during assembly.

One of the bearing portions 72 (left one as viewed in FIG. 6) is provided with a pin 76 which fits in a small-diameter bore **14*b* (FIG. 8) formed in the underside of the shaft 14*a*. The pin 76 serves to prevent the shaft 14*a* from being rotated about its axis and so that the roller 14 rotatable about the shaft 14*a* is effectively maintained in an accurate position relative to the developing roller 24 (FIG. 1). Since the shafts 14*a* and 16*a* supported by the independent frames 52 and 54 are movable toward and away from each other, integral construction of the shafts 14*a* and 16*a* with their associated rollers 14 and 16 would give rise to a problem that the distance between the shafts 14*a* and 16*a* is directly dictated by the bearing portions 72 and 74 of the upper and lower covers 56 and 58, that is, it is apt to be effected by the wear of the bearing portions 72 and 74 and finishing precision. This can be eliminated by fixing the shaft 14*a* to the bearing portion by the pin 76 as described above, forming the roller as a tubular shaft, and rotatably mounting it on the shaft 14*a*. For the same reason, the other roller 16 is rotatably mounted on the shaft 16*a* with the intermediary of a tubular shaft 16*b* (FIGS. 9 and 10**).

Figure 9:
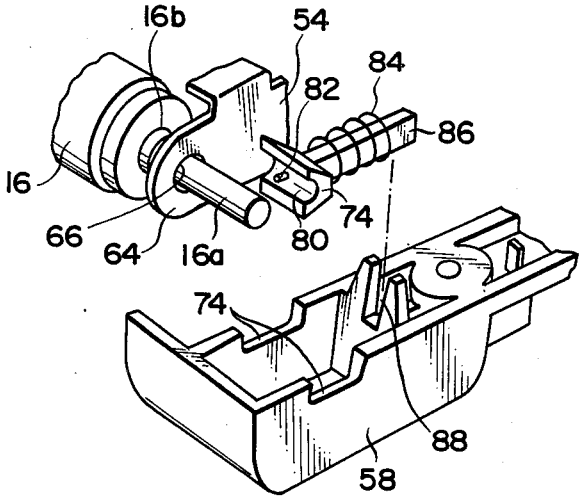
FIG. 9 is a fragmentary exploded perspective view showing correspondence between the other roller support shaft and a lower cover during assembly.

To check the rotation of the shaft **16*a*, a pair of right and left slide pieces 78 such as shown in FIG. 9 are used. Each slide piece 78 includes a bearing portion 80 and a pin 82 protruding from the bearing portion 80. The pin 82 fits in a small-diameter bore (not shown) provided in the shaft 16*a*. A spring 84 is wound around a slide arm 86 of the slide piece 78 preloaded to bias the shaft 16*a* such that the distance between the axes of the shafts 14*a* and 16*a* increases. The slide piece 78 thus is bifunctional as a support for supporting the spring 84. The slide arm 86 is slidably received in a channel 88 which is located behind the associated bearing portion 74 in the lower cover 58**.

As seen from the above, the shaft **16*a* is constantly biased to the left by the spring 84 wound around the slide piece 78 so that the belt 12 is stretched between the rollers 14 and 16. In the photoconductive element unit 50, therefore, the belt 12 is constantly held under tension between the rollers 14 and 16**.

Figure 10:
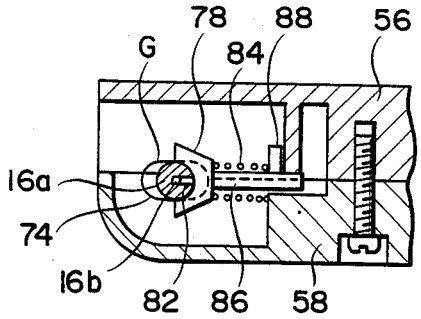
FIG. 10 is a fragmentary section of a roller support shaft bearing portion.
Figure 11:
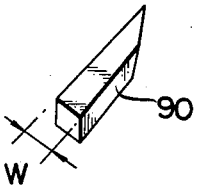
FIG. 11 is a perspective view of an example of a loosening member.

Referring to FIG. 10, a space G is shown in which the left side of the shaft **16*a* and those of the bearing portions 74 of the upper and lower covers 56 and 58 face each other. A generally wedge-like loosening member 90 is shown in FIG. 11. When the loosening member 90 is inserted into the space G, it will urge the shaft 16*a* against the action of the spring 84 toward the other shaft 14*a*, that is, in a direction for reducing the distance between the shafts 14*a* and 16*a* to reduce the tension in the belt 12. In this manner, the loosening member 90 will release the tension from the belt 12 when inserted into the space G while the unit 50** is out of use.

Figure 12:
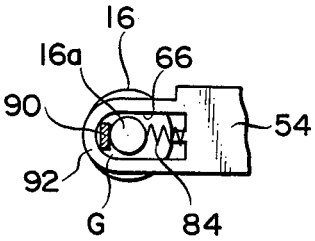
FIG. 12 is a fragmentary side elevational view of a roller support shaft bearing portion of another photoconductive element unit in accordance with the present invention.

In the above example, the support frame for supporting the rollers 14 and 16 is made up of the main frame 52 and the subframe 54 which are physically independent of each other. However, as shown in FIG. 12, even where the shaft **16*a* is received in slots which are formed through an end portion 92 of single support frame 54, the loosening member 90 may be inserted into the space G between the shaft 16*a* and the opening 66 overcoming the resiliency of the spring 84, so as to reduce the tension in the belt 12**.

The loosening member 90 has a width W which is dimensioned greater than the width of the space G. Identical sets of the slide piece 78 and spring 84 are associated with opposite end portions of the shaft **16*a***.

In the manner described, the photoconductive unit 50 is built up by extending the frames 52 and 54 away from each other, fitting the shafts **14*a* and 16*a* respectively in the bearing portions 72 and 74 of the lower cover 58, mating the upper cover 56 with the lower cover 58 to locate the shafts 14*a* and 16*a* and the slide pieces 78 in predetermined positions, and fastening the upper and lower covers 56 and 58** by screws.

The belt 12 of the photoconductive element unit 50 described above is held under tension so long as it is installed inside the upper and lower covers 56 and 58. While the unit 50 is out of use, therefore, the belt 12 undergoes creep deformation which results in the previously discussed problematic situation.

Figure 13:
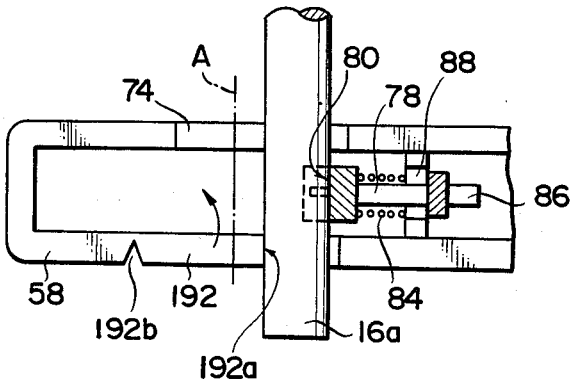
FIG. 13 is a plan view of an embodiment of a structure for reducing the tension of a belt-like photoconductive element when the latter is out of use in accordance with the present invention.
Figure 14:
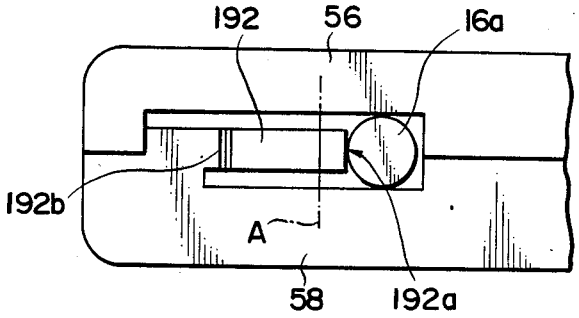
FIG. 14 is a side elevational view of the structure shown in FIG. 13.

In light of the above, as shown in FIGS. 13 and 14 by way of example, the bearing portions 74 of the lower cover 58 may each be provided with a tongue 192 which abuts against the shaft **16*a* from outside. An end 192*a* of the tongue 192 abutting against the shaft 16*a* assumes a position inwardly of a position A where the outermost side periphery of the shaft 16 will align with the bearing portion 74 of the lower cover 58 when the unit 50 is operation, that is, when the belt 12 is stretched in its operative position. In such a position, the tongue end 192*a* urges the shaft 16*a* against the action of the spring 84 in a direction for reducing the distance between the rollers 14 and 16. The tongue 192 is also provided with a notch 192***b* in a position thereof which is at least outwardly of the position A.

The tongues 192 extending from the opposite bearing portions 74 of the lower cover 58 hold the shaft 16*a* of the roller 16 urged toward the other shaft 14*a*, whereby the belt 12 wrapping around the rollers 14 and 16 is favorably slackened.

The unit 50, therefore, will develop no creep deformation in the belt 12 even if stored over a long period of time without being used.

The tongues 192 will be snapped off in the event of use of the unit 50, that is, when the unit 50 is put in a copier or like apparatus. They can easily be snapped off at the notch 192 by pressing them from outside. As soon as the tongues 89*a* are removed, the shaft 16*a* is urged by the spring 84 to the left in FIG. 13 with the result that the distance between the shafts 14*a and 16a* of the rollers 14 and 16 is increased to stretch the belt 12 as in the prior art unit.

Figure 15:
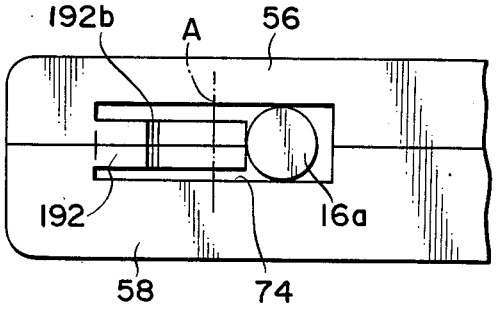
FIG. 15 is a side elevational view of another embodiment of the present invention.
Figure 16:
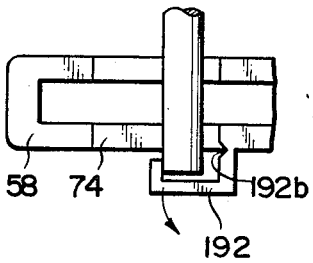
FIG. 16 is a plan view of yet another embodiment of the present invention.

While the tongues 192 have been shown and described as being provided in the lower cover 58 only, they may be provided in both the upper and lower covers 36 and 58, as shown in FIG. 15. Furthermore, as shown in FIG. 16, tongues 192 may be positioned on side walls of the lower cover 58 (or upper cover), instead of those which are formed by extending outward side edgee of the bearing portions of the cover as described above.

Figure 17:
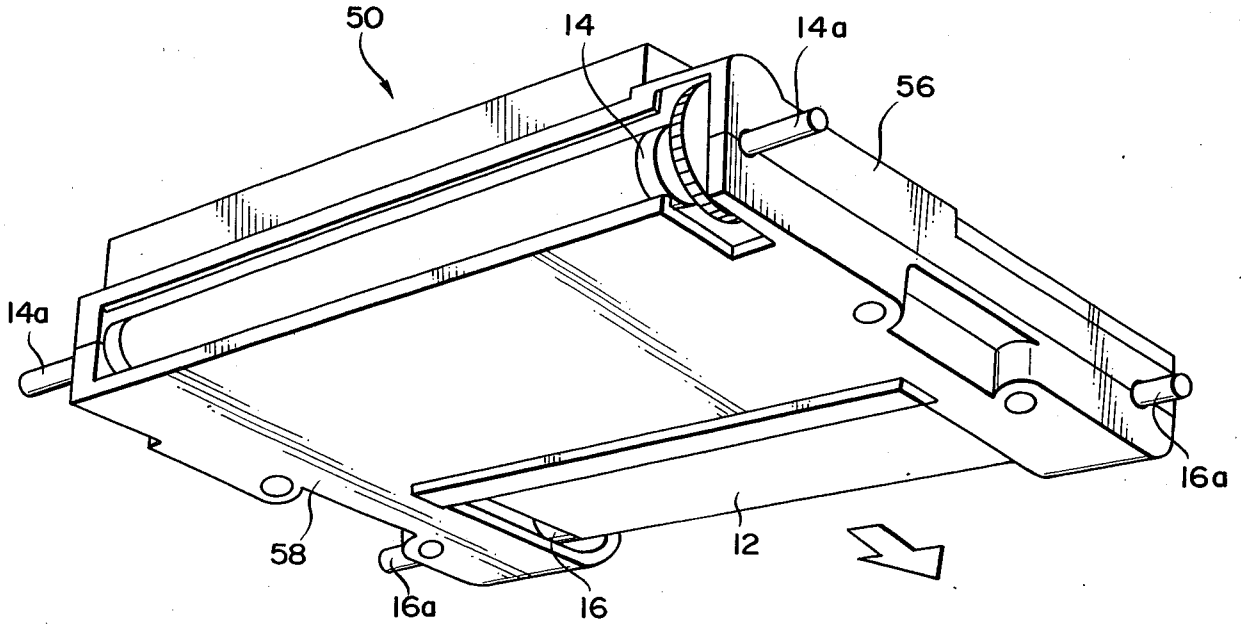
FIG. 17 is a plan view of an embodiment of a photoconductive element unit provided with a guide structure in accordance with the present invention.

Meanwhile, as shown in FIG. 17, the shafts 14*a* and 16*a* of the photoconductive element unit 50 in accordance with the present invention are extended outwardly beyond the opposite sides of the covers 56 and 58, so that their end portions provide guide means for guiding the movement of the unit 50 into and out of the apparatus. In this example, the shaft 14*a* associated with the roller 14, which is a drive roller, is designed longer than that of the shaft 16*a* associated with the roller 16 which is a driven roller.

Figure 18:
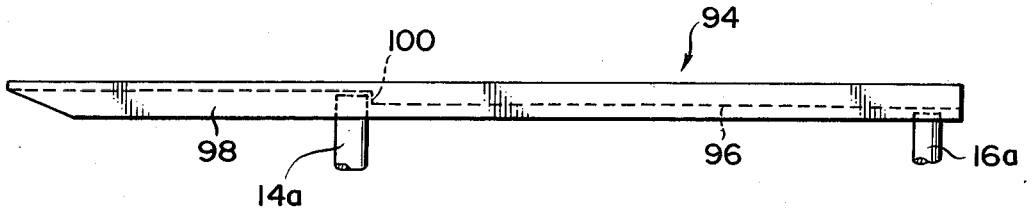
FIG. 18 is a plan view of a guide member included in the guide structure shown in FIG. 17 and associated with a housing of a recording apparatus.
Figure 19:
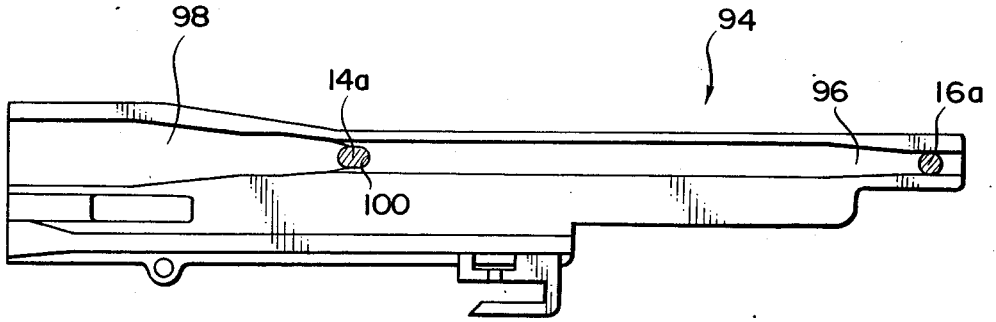
FIG. 19 is a side elevational view of the guide member of FIG. 18.

Guide means provided in the apparatus to cooperate with the above-mentioned guide means of the unit 50 is shown in FIGS. 18 and 19. As shown, the guide means of the apparatus comprises a guide member 94 with which the shafts 14*a* and 16*a* are engageable for guiding the unit 50 into the apparatus. The guide member 94 is adapted to guide the shafts 14*a* and 16*a* at the left-hand side (in FIG. 7) of the unit 50 with respect to the intended direction of insertion of the unit 50 into the apparatus and fixedly mounted on a left side panel of the housing (not shown) of the apparatus.

Another guide member substantially identical in configuration with the guide member 94 is mounted on a right side panel (not shown) of the apparatus housing which extends parallel to the left side panel. Facing the left guide member 94, the right guide member is adapted to guide the shafts 14*a* and 16*a* at the righthand side of the unit 50.

As shown in FIG. 18, the guide member 94 is provided with a guide channel 96 for guiding the shaft 16*a* associated with the driven roller 16 and a guide channel 98 for guiding the shaft 14*a* associated with the drive roller 14. The guide channel 96 is shallower than the guide channel 98. A shoulder 100 formed between the guide channels 96 and 98 due to the difference in depth functions as a stop for stopping the shaft 14*a* which is guided by the guide channel 98, thereby positioning the unit 50 inside the apparatus housing.

Further, the guide channel 96 is somewhat deeper in a trailing portion with respect to the intended direction of insertion of the unit 50 (left portion in FIG. 18) than in a leading portion, whereby the shaft 16*a* is allowed to move smoothly along the guide channel 96. Concerning the width, each of the guide channels 98 and 96 is wider in a trailing portion than in a leading portion with respect to the above-mentioned direction, as shown in FIG. 19. As seen in FIG. 19, the shaft 16*a* associated with the driven roller 16 is guided by the guide member 94 before the other shaft 14*a* during insertion of the unit 50. The shaft 16*a* is resiliently supported by the covers 56 and 58 as previously described and, in addition, the direction of insertion of the shaft 16*a* into the guide channel 94 is such that the shaft 16*a* is displaced against the resiliency in such a manner as to reduce the tension in the belt 12 installed in the unit 50. Hence, the guide structure described above prevents the belt 12 from being damaged while the unit 50 is inserted into the apparatus housing. Although some inconvenience may be experienced at the time of removing the unit 50 from the apparatus housing, unintentional damage to the belt 12 during the removal is no problem since the removal of such a disposable unit is intended in most cases for replacement only.

As described above, the shaft 16*a* is inserted into the guide channel 96 in a loosening direction, a narrow spacing (e.g. about 0.3 millimter) is left between each end of the shaft 16*a* and the adjacent bottom of the guide channel 96 so that the resiliency which biases the shaft 16*a* may be insured.

Referring again to FIG. 1, the covers 56 and 58 of the photoconductive element unit 50 are provided with an opening A at a charging station, an opening B at an exposing station, an opening C at a developing station, an opening D at a transfer-charging station, and an opening E at a cleaning station. The openings A, B, C, D and E respectively are faced by the previously mentioned charger 18, optical system 20, developing roller 24, transfer charger 36, and cleaning roller 102. The operation of the apparatus 10 will be described again.

The belt 12 is charged by the charger 18, then illuminated by an information carrying laser beam via the optical system 20 to form a latent image, and then has the latent image developed by the developing roller 24. A sheet 28 is fed by the sheet feed rollers 30 from the top of the stack in the sheet cassette 26, the rollers 32 preventing simultaneous feed of a plurality of sheets. The sheet 28 is nipped between the register rollers 34 and held thereby until the leading end of the toner image on the belt 12 comes to align with the leading end of the sheet 28 in response to the rotation of the belt 12. Then, the register rollers 34 are rotated to feed the sheet 28 along a pair of sheet guide plates 104 and 106 to between the belt 12 and the transfer charger 36. The toner image is transferred by the transfer charger 36 to the sheet 28 and, then, conveyed via the guides 38 and 40 toward the fixing roller 42. The sheet 28 with the toner image fixed by the fixing roller 42 is fed out to the tray 48 guided by the guide 44.

The guide for the sheet 28 having been nipped between the register rollers 34 is provided by the sheet guide plate 104 located in the vicinity of the belt 12, which is exposed to the outside through the opening D of the lower cover 58, and the sheet guide plate 104 located to face the sheet guide plate 104. In the prior art apparatus, the end of the sheet guide plate 106 has been extended to close proximity of the belt 12 to bring about the previously discussed various problems.

Figure 20:
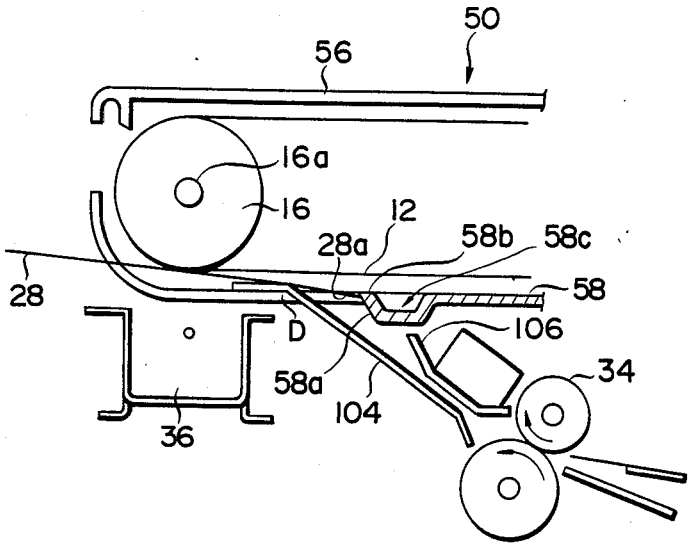
FIG. 20 is a fragmentary side elevational view of an embodiment of a photoconductive element unit which is constructed to promote smooth feed of a rear end portion of a sheet in accordance with the present invention.

In accordance with the present invention, the above situation is settled by a unique configuration in that portion of the lower cover 58 of the unit 50 which is adjacent to the opening D in the transfer station. As shown in FIG. 20, an end portion of the lower cover 58 adjacent the opening D is configured to provide a sheet guide portion 58*c* which includes a sheet guide surface 58*a* facing the sheet guide plate 104 and is constructed such that the upper edge 58*b* of the sheet guide surface 58*a* is positioned not lower than a tangential line interconnecting the image forming surface of the belt 12 and the sheet guide surface of the plate 104. Due to such a position of the upper edge 58*b* of the sheet guide surface 58*a*, the sheet guide portion 58*c* positions the rear end portion 28*a* of the sheet 28 substantially horizontal when the latter is aligned with the tangential line, while maintaining the sheet rear end below the upper edge 58*b* of the sheet guide surface 58*a*. In this condition, the sheet being guided by the sheet guide portion 58*c* becomes always flat as its rear end leaves the sheet guide surface 58*a*. As a result, restoring resiliency stored in the sheet 28 due to bending of its rear end portion 28*a* between the sheet guide plate 104 and the belt 12 and complementary to the elasticity of the sheet is cancelled in the course of feeding, that is, as soon as the rear end portion 28*a* aligns with the tangential line, whereby the rear end portion 28*a* is restrained from jumping up toward the belt 12.

Figure 21:
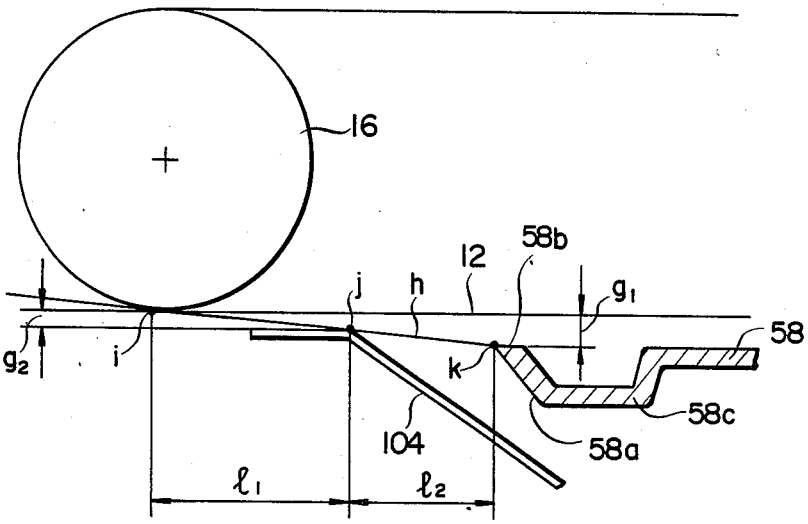
FIG. 21 is a side elevational view showing positional correspondence between a photoconductive element, a sheet guide plate and a sheet guide portion which are associated with the construction of FIG. 20.

An exemplary positional correspondence between the belt 12, sheet guide plate 104, and sheet guide surface 58*a* of the sheet guide portion 58*c* is shown in FIG. 21. In this example, the upper edge 58*b* of the sheet guide surface 58*a* is located at a level which coincides with the tangential line h. In FIG. 21, i represents the point of contact of the line h and the image forming surface of the belt 12, j the point of contact of the line h and the seat guide surface of the sheet guide plate 104, and k the point of contact of the line h and the sheet guide surface 58*a*. The above-described effect was accomplished when the horizontal distance $l_1$ between the points i and j was about 14 millimeters, the horizontal distance $l_2$ between the points j and k was about 11 millimeters, the gap $g_1$ between the point k and the belt 12 was about 2.5 millimeters, and the gap $g_2$ between the point j and the belt was about 1.5 millimeters.

The main frame 52, as will be understood from the above discussion, constitutes a basic element in loading the belt 12 in the unit 50 and, hence, has to be far higher in structural strength than the the others such as the subframe 54, upper cover 56 and lower cover 58. A grid plate is mounted on the main frame 52 which has such a mechanical strength.

Figures 22, 23:
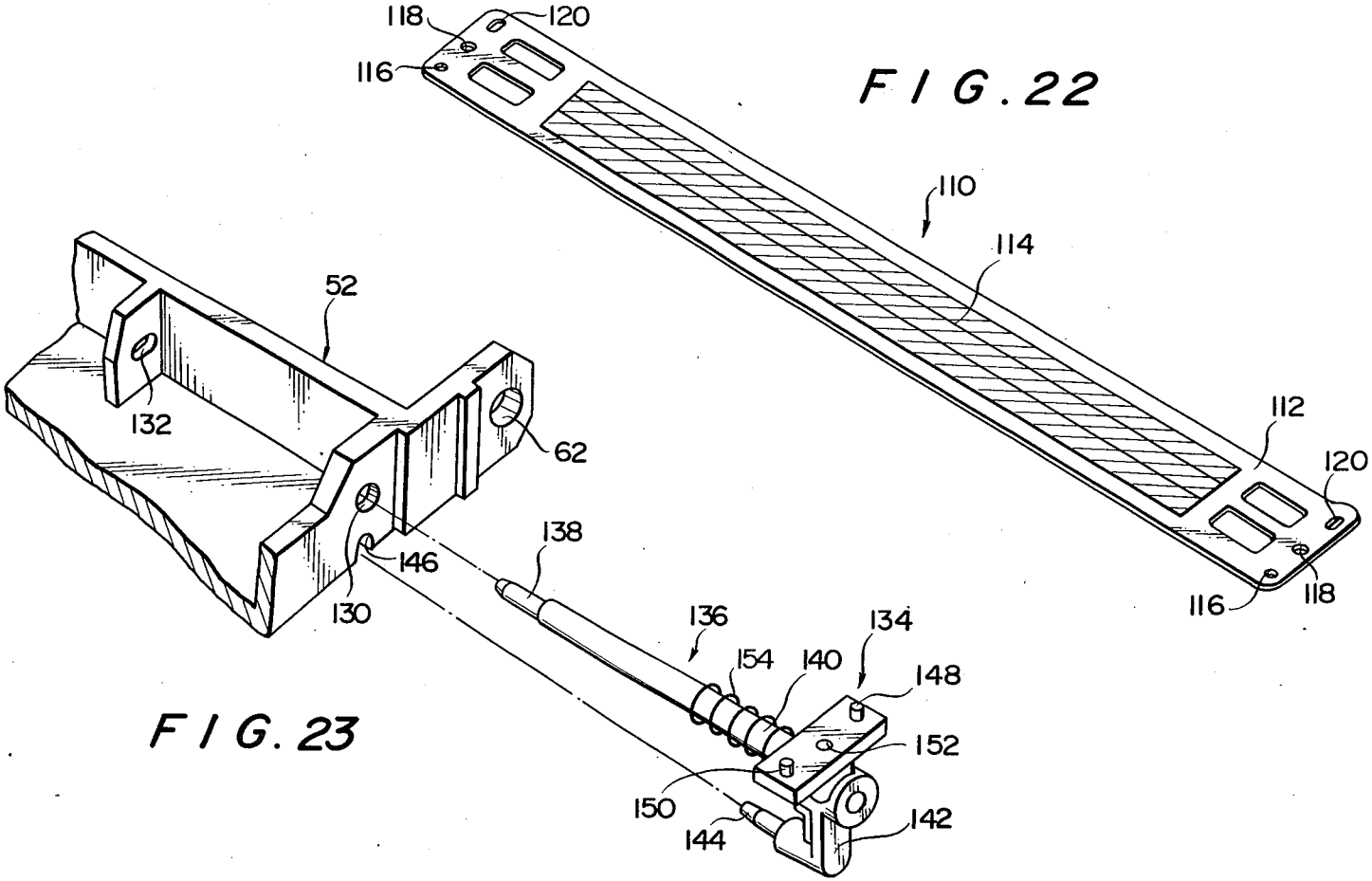
FIG. 22 is a perspective view of an example of a grid plate.
FIG. 23 is a perspective view showing correspondence between a second support block and a main frame.

As shown in FIG. 1, a grid plate 110 is interposed between the charger 18 and the belt 12 in such a manner as to cover an opening 18*a* of the charger 18. As best shown in FIG. 22, the grid plate 110 comprises a sheet of stainless steel 112 a central area of which is etched to provide a mesh portion 114 having a line width of about 0.1 millimeter and a pitch of about 1 millimeter. Three small holes 116, 118 and 120 are formed through each of longitudinally opposite end portions of the grid plate 110.

Meanwhile, the main frame 52 to which the grid plate 110 is to be mounted includes a first support block 122 located in a right portion thereof as viewed in FIG. 3. Provided on the top of the first support block 122 are a pair of pins 124 and 126 and a threaded hole 128 which correspond in position to the holes 116, 118 and 120 of the grid plate 110 located in the right end portion as viewed in FIG. 22. The main frame 52 is provided with a hole 130 extending throughout its side wall in a left portion as viewed in FIG. 3 and a slot 132 extending throughout a wall-like projection which faces the hole 130. FIG. 23 is a fragmentary view of the left portion of the main frame 52 of FIG. 3 as seen from behind. As shown, a stepped shaft 136 extends from a downwardly extending arm of a second support block 134 to be passed through the hole 130 and slot 132 of the main frame 52. The stepped shaft 36 has a base portion 140 and a tip portion 138 which is smaller in diameter than the base portion 140. With the tip portion 138 received in the slot 132 (as shown in FIG. 3), the shaft 136 is free to move in a plane which is parallel to the image forming surface of the belt 12. The slot 132 is adapted for allowing the shaft 136 to pivot to maintain the grid plate 110 parallel to the belt 12 without being twisted. If desired, the stepped shaft 136 may be replaced with a simple straight shaft.

A stub shaft 144 extends from the lower end of the arm 142 of the second support block 134 in parallel to the stepped shaft 136. When the base portion 140 of the shaft 136 is received in the hole 130 (FIG. 3), the stub shaft 144 is received in a notch 146 which is positioned below the hole 130. In this position, the stub shaft 144 functions to constantly hold the top of the second support block 134 parallel to the image forming surface of the belt 12 when the shaft 136 is caused to pivot or slide. Provided on the top of the support block 134 are a pair of pins 148 and 150 and a threaded hole 152 which are associated with the holes 116, 118 and 120 formed through the left end portion of the grid plate 110 as viewed in FIG. 22. A coiled compression spring 154 is wound around the shaft 136 so that when the support block 134 is mounted on the main frame 52, the support block 134 will be biased outwardly away from the main frame 52.

The grid plate 110 is fixed to the main frame 52 by mating the holes 116 and 120 at both ends of the grid plate 110 with the pins 124, 126, 148 and 150 of the first and second support blocks 122 and 134 and, then, driving screws into the threaded holes 128 and 152 by way of the associated holes 118. In this connection, if both the support blocks 122 and 134 are rigid on the main frame 52, severe accuracy requirement will be imposed on the grid plat 110 and main frame 52 in order to eliminate slackening, twisting and other undesirable conditions of the grid plate 110 when the holes 116 and 120 of the grid plate 110 are mated with the pins 124, 126, 148 and 150. In the illustrative embodiment, in contrast, the second support block 134 is movable along the length of the grid plate 110 and pivotable along the width of the same to a position where slackening, twisting or the like due to dimensional errors will be removed, thereby providing the mesh portion 114 with a considerably flat profile.

The holes 120 of the grid plate 110 which are engaged with the pins 126 and 150 are each configured as a slot for allowing the grid plate 110 to pivot in response to a pivotal motion of the second support block 134. For reinforcement, the main frame 52 is provided with ribs 156. Further, the upper cover 56 is provided with an elongate window 158 to allow the grid plate 110 to show itself therethrough.

Figure 24:
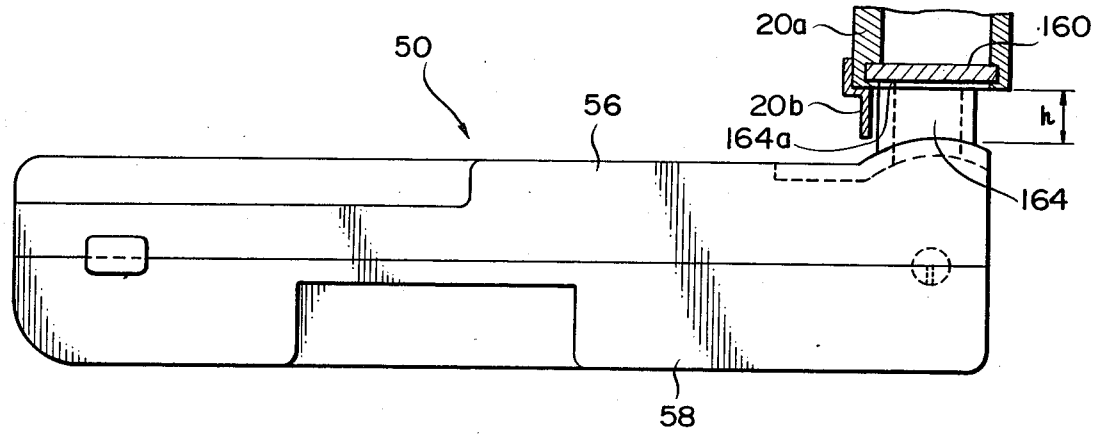
FIG. 24 is a side elevational view of an embodiment of a photoconductive unit constructed to prevent developer particles and others from depositing on a dust-tight glass in accordance with the present invention.

Referring again to FIG. 1, a dust-tight glass 160 is positioned below the optical system 20, and a fan 162 in a position adajcent to the discharge tray 48 and isolated from the developing roller 24. During operation of the apparatus, the fan 162 generates a stream of air as indicated by an arrow b which in turn entrains toner particles and others, giving rise to various problems. In light of this, as shown in FIGS. 1 and 2, the opening B at the exposing station of the unit 50 is surrounded by a frame 164 (an opening at the exposure station of the prior art unit has been configured simply flat as the opening A at the charging station). The frame 164 rises to a height h which is such that the edge 164*a* of its opening is located as close as possible to the underside of the glass 160 which is positioned at the outlet of the optical path defined in the casing 20*a* of the optical system, as shown in FIGS. 1 and 24. The frame 164 surrounding the opening B of the cover 52 as described above cooperates with the casing 20*a* to divide the space above the unit 50 into right and left compartments, so that the compartment accommodating the developing roller 24 is freed from the influence of the air stream generated by the fan 162.

As shown in FIG. 24, a plate 20*b* may be provided to extend downwardly from a side surface of the casing 20*a* toward the base of the frame 154 in order to further enhance the interception of the air stream.

The present invention described hereinabove achieves the following various and unprecedented advantages.

(1) Since a support frame for supporting a photoconductive element is made up of a main frame and a subframe which is free to extend and contract relative to the main frame, a substantial displacement stroke of opposite rollers associated with the photoconductive element is available to enhance easy loading of the element without damaging it. Also, since the distance between shafts associated with the individual rollers is variable with no regard to the resiliency of springs which tend to increase that distance, resiliency of the spring is prevented from being deteriorated when the photoconductive element is loaded.

(2) Two different functions, i.e. preventing the shafts from rotating and yieldably biasing the same, are accomplished by a very simple construction which comprises slide pieces and springs wound around the individual slide pieces, that is, sharing the same members.

(3) While the unit is out of use, the distance between the shafts associated with the rollers is reduced by a loosening member and, hence, the tension in the photoconductive element is reduced to eliminate creep deformation or the like.

(4) While the unit is out of use, tongues constantly bias the shafts inwardly against resilient forces acting on the shafts and, thereby, free the photoconductive element from tension which would otherwise result in deformations. Since the tongues are provided integrally with covers of the photoconductive element unit, they do not increase the number of parts or that of assembling steps, which has grave influence on costs.

(5) Guide means for guiding the unit relative to an apparatus housing is attainable merely by designing the two shafts of the unit to be relatively long and to extend them outwardly beyond the sides of the covers. This is desirable in providing the unit with a disposable design inasmuch as the number of parts or that of assembling steps will not be increased. In addition, the use of the shafts for guiding the unit offers an accuracy incomparable to those of other types of guide means because they define reference axes for setting up correspondence of the unit with various operating stations in the apparatus housing.

(6) The rear end portion of a sheet being fed toward a transfer station is guided by a sheet guide surface which is located in a portion of a lower cover of the unit which neighbors an opening of the lower cover at the transfer station. Such allows the sheet guide surface to be positioned near the photoconductive element and, thereby, prevents the sheet rear end portion from springing. Since the sheet guide surface is implemented by a part of the unit, relative displacement between the sheet guide surface and the photoconductive element does not occur even if the former makes contact with the latter during loading or unloading of the unit. The sheet guide surface which is integral with the lower cover is attainable without increasing the number of parts of the unit or that of assembling steps. Further, the sheet guide surface is inclined relative to the lower cover so that it functions as a kind of rib to enhance the mechanical strength of the lower cover.

(7) Since a grid plate is supported by the main frame which is strongest of all the structural elements of the unit, support members for supporting the grid plate are prevented from being deformed by the tension acting on the grid plate and, in addition, the grid plate is free from slackening or twisting. The grid plate, therefore, accomplishes a considerable degree of parallelism in relation to the photoconductive element. With these advantages, the present invention eliminates deformations of the grid plate and its support members, damage to the photoconductive element due to dimensional errors, or a decrease in assembling accuracy.

(8) A frame extending from an upper cover of the unit bisects a space defined above the cover so as to intercept toner and other particles which would otherwise be introduced from a space around a developing roller into a space around a charger. The frame, therefore, eliminates contamination of the charger by the toner which might lead to unusual discharging, a source of breakage of a charging wire or damage to the photoconductive element. Since the frame surrounds an opening of the upper cover at the exposing station, it checks entry of toner particles and external light into an optical path for exposure, thereby eliminating a decrease in the quantity of light.

(9) Further, due to the frame located in the opening at the exposing station, the charger positioned in the upstream side with respect to a copying cycle lies in the most upstream portion of a stream of air generated by a fan and, hence, ozone entailed by the charger can be dissipated more effectively. Also, the frame which may be formed integrally with the upper cover of the unit does not increase the number of parts or that of assembling steps.

Various modifications will become possible for those skilled in the art after receiving the teachings of the present disclosure without departing from the scope thereof.

What is claimed is:

1. A photoconductive element unit removably mounted in a recording apparatus and having a belt-like photoconductive element, comprising:

a support frame member including a main frame and a subframe arranged to be extensible and contractible relative to said main frame;

a pair of rollers mounted on individual support shafts which respectively are supported by an end portion of the main frame and an end portion of the subframe which are remote from each other;

biasing means for biasing said rollers in a direction for yieldably increasing a distance between the rollers to mounting the photoconductive element in a loop form over the rollers under tension in such a manner as to cover the frame member;

an upper cover and a lower cover for accommodating the frame member therein wherein the biasing means further comprises a spring anchored to one of the upper and lower covers to abut against the support shaft associated with one of the rollers; and slide means which includes a first bearing portion engaged with an inner side surface of the support shaft of one of said rollers, a pair of second slot-like bearing portions formed on opposite sides of said lower cover, a channel member located adjacent to and between said pair of slot-like bearing portions, a slide arm positioned in said channel member integral with said first bearing portion and extending from said first bearing portion towards said one roller, wherein said spring further comprises a coil spring yieldably wound around said slide arm, and a pin for resiliently engaging the bearing portion with the support shaft of the one roller, said slide means being slidably supported by the upper and lower covers.

2. A photoconductive element unit as claimed in claim 1, wherein the pair of rollers comprise a drive roller and a driven roller the support shaft of which is slidable relative to the support shaft of said drive roller.

3. A photoconductive element unit as claimed in claim 2, further comprising loosening means for displacing the support shaft of said one roller toward the support shaft of the other roller against the resiliency of the spring, said loosening means being inserted into a space defined between each of the support shafts and support shaft bearing portions of the upper and lower covers.

4. A photoconductive element unit as claimed in claim 2, wherein opposite ends of each of the support shafts of the rollers extend outwardly from the upper and lower covers through bearing portions provided in the covers.

5. A photoconductive element unit as claimed in claim 2, further comprising sheet guide means provided in an end portion of an opening which is located in a transfer station and having a sheet guide surface which faces a sheet guide plate adjacent to the photoconductive element which is exposed to the outside through said opening.

6. A photoconductive element unit as claimed in claim 5, wherein an upper edge of said sheet guide surface of said sheet guide means is positioned not lower than a tangential line interconnecting an image forming surface of the photoconductive element and the sheet guide surface of the sheet guide plate.

7. A photoconductive element unit as claimed in claim 2, further comprising grid plate support means for supporting a grid plate which is interposed between a charger located to face an image forming surface of the photoconductive element and said image forming surface.

8. A photoconductive element as claimed in claim 7, wherein said grid plate support means comprises a first support block provided in one side portion of the main frame and having a pair of pins for supporting one end portion of the grid plate, and a second support block having a pair of pins for supporting the other end portion of the grid plate and located in the other side portion of the main frame to be movable along a length of the grid plate and pivotable along a width of the grid plate, said second support block being biased outwardly away from the main frame.

9. A photoconductive element unit as claimed in claim 2, further comprising a frame disposed in a position corresponding to a dust-tight glass which is positioned at an outlet of an optical path defined in an optical exposing system of the recording apparatus, said frame surrounding edges of said outlet.

10. A photoconductive element unit removably mounted in a recording apparatus and having a belt-like photoconductive element, comprising:

a support frame member comprising a main frame and a subframe arranged to be extensible and contractible relative to said main frame;

a pair of rollers mounted on individual support shafts which respectively are supported by an end portion of the main frame and an end portion of the subframe which are remote from each other wherein said pair of rollers comprise a drive roller and a driven roller the support shaft of which is slidable relative to the support shaft of said drive roller;

biasing means for biasing said rollers in a direction for yieldably increasing a distance between the rollers to mounting the photoconductive element in a loop form over the rollers under tension in such a manner as to cover the frame member;

an upper cover and a lower cover for accommodating the frame member therein wherein at least one of said upper and lower covers includes a bearing portion and wherein said biasing means comprises a spring anchored to one of said upper and lower covers to abut against the support shaft associated with one of the rollers which is supported by one of the main frame and the subframe; and a removable tongue having a snapable notched portion and provided in said bearing portion of said at least one of the upper and lower covers for bearing the support shaft of one of said rollers, said tongue displacing the support shaft, which is in a position for applying tension to the photoconductive element, in contact with an outer surface portion of said support shaft.

11. A photoconductive element unit as claimed in claim 10, wherein the tongue is freely removable.

* * * * *